US011480331B1

(12) United States Patent
Mabe

(10) Patent No.: US 11,480,331 B1
(45) Date of Patent: Oct. 25, 2022

(54) NIGHT LIGHT ASSEMBLY

(71) Applicant: Sherri Mabe, Louisville, KY (US)

(72) Inventor: Sherri Mabe, Louisville, KY (US)

( * ) Notice: Subject to any disclaimer, the term of this patent is extended or adjusted under 35 U.S.C. 154(b) by 0 days.

(21) Appl. No.: 17/343,910

(22) Filed: Jun. 10, 2021

(51) Int. Cl.
*F21V 37/00* (2006.01)
*F21V 33/00* (2006.01)

(52) U.S. Cl.
CPC ..... *F21V 37/0095* (2013.01); *F21V 33/008* (2013.01); *F21V 33/0056* (2013.01)

(58) Field of Classification Search
CPC ..... F21V 37/0095
See application file for complete search history.

(56) References Cited

U.S. PATENT DOCUMENTS 5,307,051 A 4/1994 Sedlmayr
7,264,377 B2 9/2007 Cooper
8,979,731 B2 3/2015 Aarts
10,086,302 B2 10/2018 Boeckle
2012/0188451 A1* 7/2012 Schmidt ..... A63H 5/00 348/E9.025

FOREIGN PATENT DOCUMENTS

WO WO2010130676 11/2010

* cited by examiner

*Primary Examiner* — Leah Simone Macchiarolo

(57) ABSTRACT

A night light assembly for soothing a child to sleep includes a housing that is structured to resemble a star to visually comfort a child. A light emitter is positioned within the housing to emit light outwardly through the housing thereby facilitating a child to be soothed by the light at night. A cassette reader is integrated into the housing and a cassette is provided that stores data comprising a pre-recorded audio message. The cassette is insertable into the cassette reader thereby facilitating the cassette reader to read the data on the cassette. A speaker is integrated into the housing to audibly emit the pre-recorded message outwardly through the sound slots.

6 Claims, 4 Drawing Sheets

NIGHT LIGHT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to night light devices and more particularly pertains to a new night light device for soothing a child to sleep. The device includes a star shaped housing, a cassette reader integrated into the housing and a light emitter integrated into the housing. The device includes a cassette that stores a message recorded by a parent and which is insertable into the cassette reader to read the message.

(2) Description of Related Art Including Information Disclosed Under 37 CFR 1.97 and 1.98

The prior art relates to night light devices including a variety of night light devices that include a motion sensor for sensing motion of a child and an audio unit for emitting an audible message to the child. The prior art discloses a sleep enhancement device that is structured to resemble an elephant and which includes an imagery projector for projecting imagery and an optical disk reader for reading a story on an optical disk. In no instance does the prior art disclose a star shaped housing with a cassette reader and a cassette with a pre-recorded audio message.

BRIEF SUMMARY OF THE INVENTION

An embodiment of the disclosure meets the needs presented above by generally comprising a housing that is structured to resemble a star to visually comfort a child. A light emitter is positioned within the housing to emit light outwardly through the housing thereby facilitating a child to be soothed by the light at night. A cassette reader is integrated into the housing and a cassette is provided that stores data comprising a pre-recorded audio message. The cassette is insertable into the cassette reader thereby facilitating the cassette reader to read the data on the cassette. A speaker is integrated into the housing to audibly emit the pre-recorded message outwardly through the sound slots.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
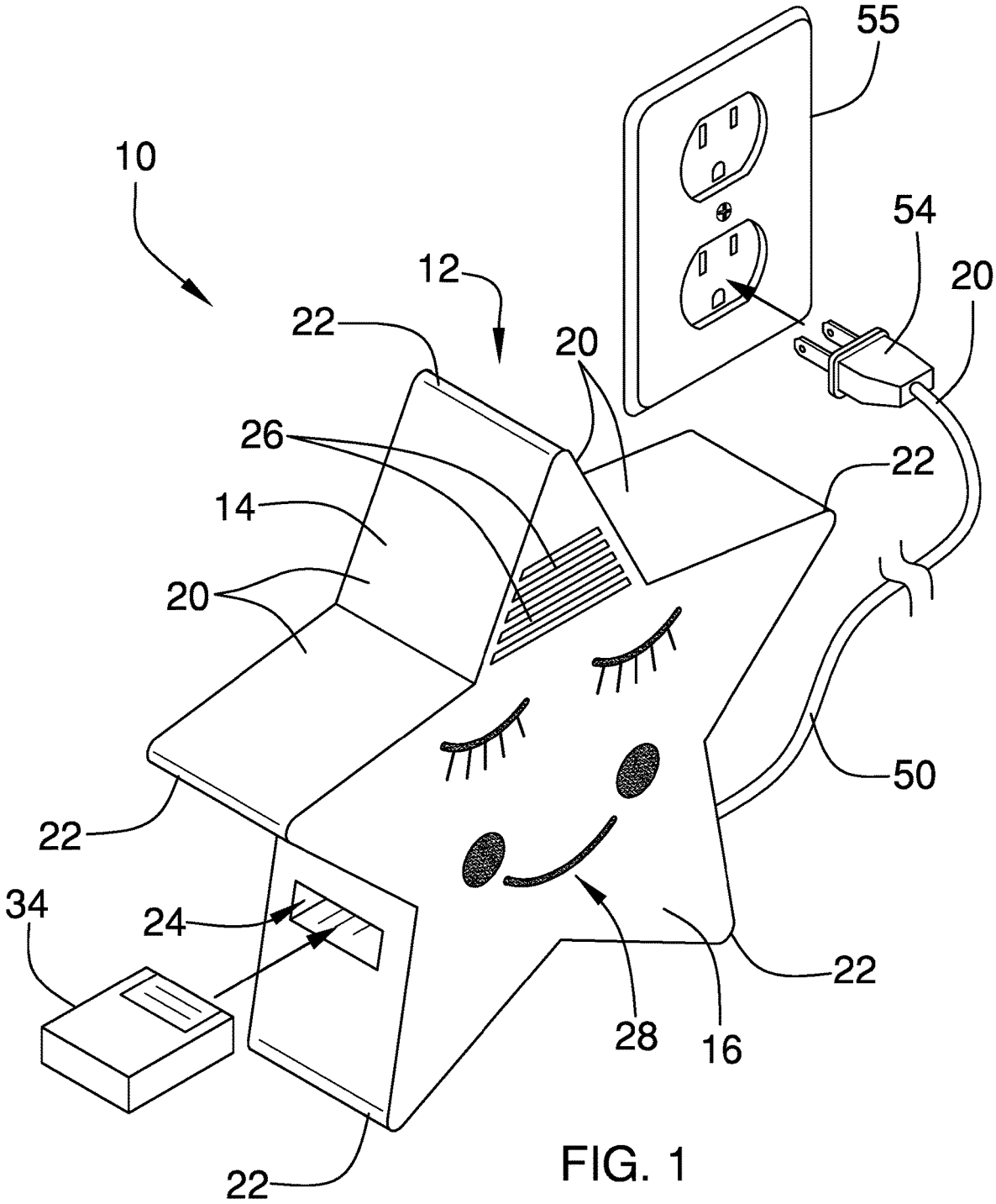
FIG. 1 is a perspective view of a night light assembly according to an embodiment of the disclosure.
Figure 2:
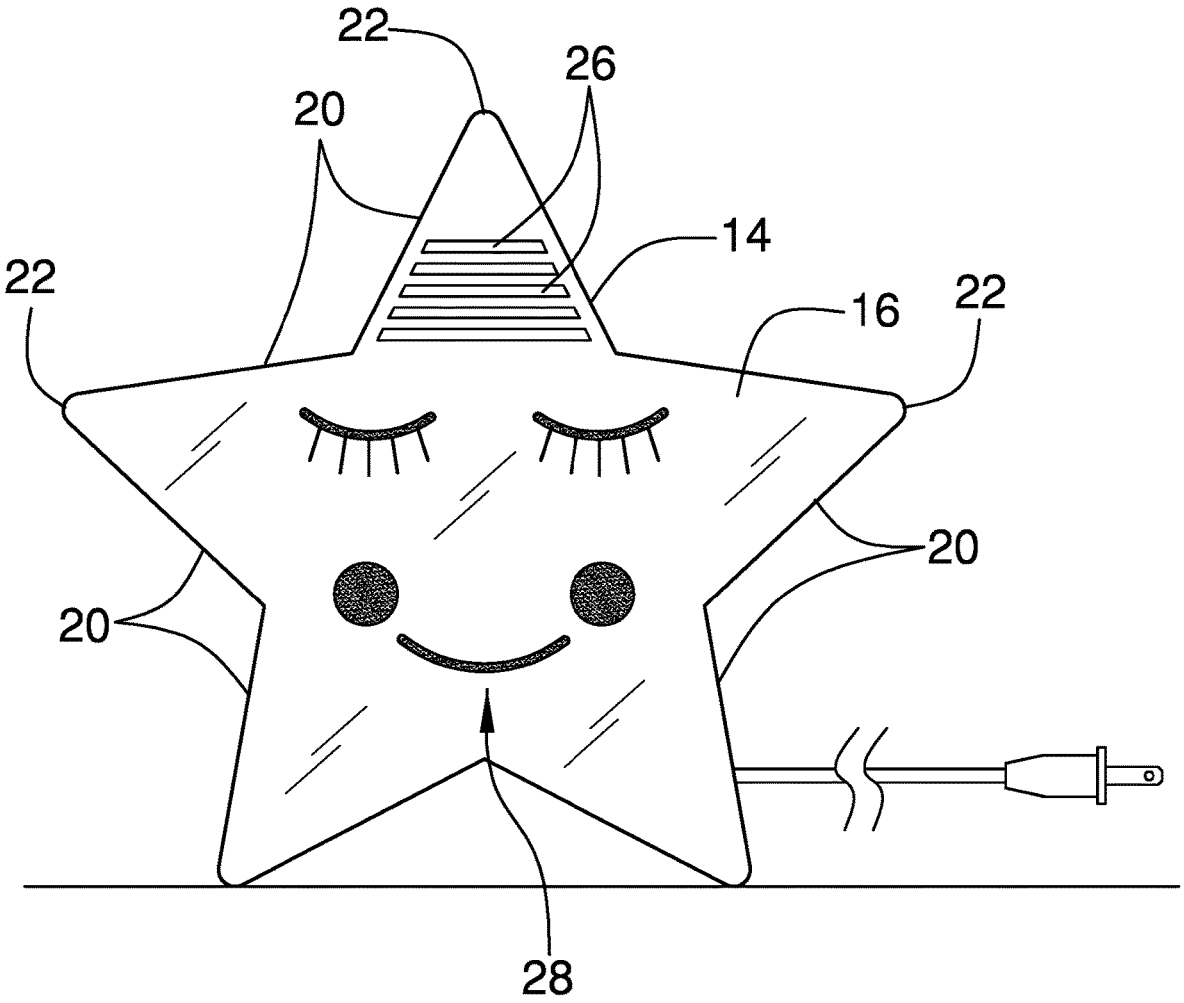
FIG. 2 is a front view of an embodiment of the disclosure.
Figure 3:
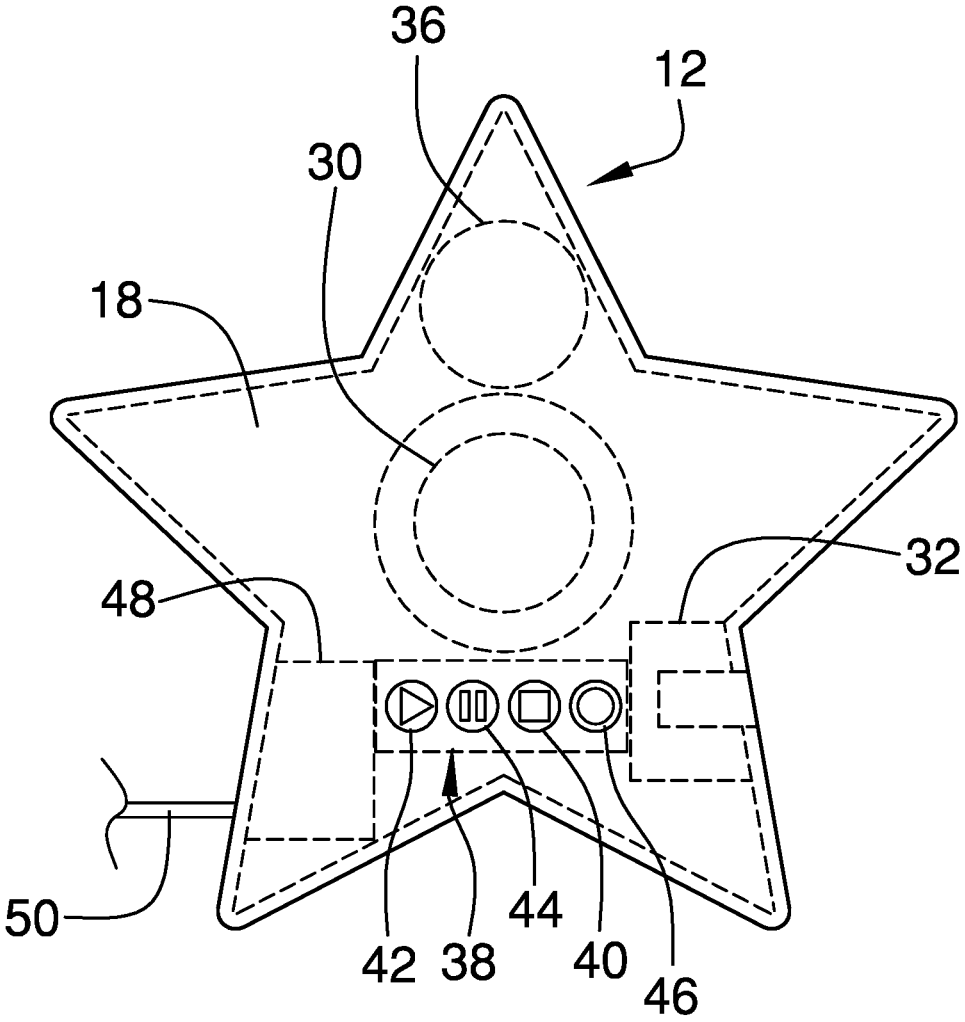
FIG. 3 is a back phantom view of an embodiment of the disclosure.

With reference now to the drawings, and in particular to FIGS. 1 through 4 thereof, a new night light device embodying the principles and concepts of an embodiment of the disclosure and generally designated by the reference numeral 10 will be described.

As best illustrated in FIGS. 1 through 4, the night light assembly 10 generally comprises a housing 12 that has an outer wall 14 which is structured to resemble a star to visually comfort a child. The housing 12 has a front wall 16 and a back wall 18, and the outer wall 14 extends between the front wall 16 and the back wall 18. The outer wall 14 has a plurality of intersecting sides 20 and the intersecting sides 20 are arranged to define a plurality of points 22 each being distributed around the outer wall 14. In this way the outer wall 14 facilitates the housing 12 to have a star shape.

The outer wall 14 has a cassette slot 24 extending into an interior of the housing 12 and the cassette slot 24 is positioned on a respective one of the intersecting sides 20. The front wall 16 has a plurality of sound slots 26 each extending into the interior of the housing 12 to pass audible sound through the sound slots 26. The front wall 16 has indicia 28 printed thereon and the indicia 28 comprise imagery of eyes and a smiling mouth. In this way the indicia 28 present the ornamental appearance of a person's face. Additionally, the housing 12 is comprised of a semitranslucent material to pass a limited amount of light through the housing 12.

A light emitter 30 is positioned within the housing 12 to emit light outwardly through the housing 12 when the light emitter 30 is turned on. In this way the child can be soothed by the light at night. The light emitter 30 may comprise a light emitting diode or other type of electronic light emitter 30. A cassette reader 32 is integrated into the housing 12 and the cassette reader 32 is aligned with the cassette slot 24 in the outer wall 14 of the housing 12. The cassette reader 32 may be an electronic cassette reader, including but not being limited to, a magnetic tape reader, a memory card reader or any other electronic data reader.

A cassette 34 is provided and the cassette 34 stores data that comprises a pre-recorded audio message. The pre-recorded audio message might be a story spoken by a family member or any other verbal message. Additionally, the pre-recorded message may include music or other form of audio entertainment. The pre-recorded message may be recorded onto the cassette 34 at the time of manufacturing. Conversely, the pre-recorded message may be recorded onto the cassette 34 by the family member with any means of voice recording that would be compatible with the design of the cassette 34. The cassette 34 is insertable into cassette slot 24 in the outer wall 14 of the housing 12 thereby facilitating the cassette reader 32 to receive the cassette 34 in order to read the data on the cassette 34. The cassette 34 may comprise a magnetic tape cassette, an electronic memory cassette or any other type of data storage cassette.

A speaker 36 is integrated into the housing 12 and the speaker 36 is aligned with the sound slots 26 to emit audible sound outwardly through the sound slots 26. The speaker 36 is electrically coupled to the cassette reader 32 to audibly emit the pre-recorded audio message. A plurality of control buttons 38 is each movably integrated into the back wall 18 of the housing 12, and each of the control buttons 38 is electrically coupled to the cassette 34 player. The plurality of control buttons 38 includes a stop button 40, a play button 42, a pause button 44 and a power button 46. The power button 46 may be electrically coupled the light emitter 30 for turning the light emitter 30 on and off.

A power supply 48 is positioned in the housing 12 and the power supply 48 is electrically coupled to the cassette reader 32 and the light emitter 30. A power cord 50 is coupled to and extends away from the outer wall 14 of the housing 12 and the power cord 50 is electrically coupled to the power supply 48. The power cord 50 has a distal end 52 with respect to the housing 12 and a male plug 54 is electrically coupled to the distal end 52. The male plug 54 can be plugged into a female electrical outlet 55 to supply power to the power supply 48.

Figure 4:
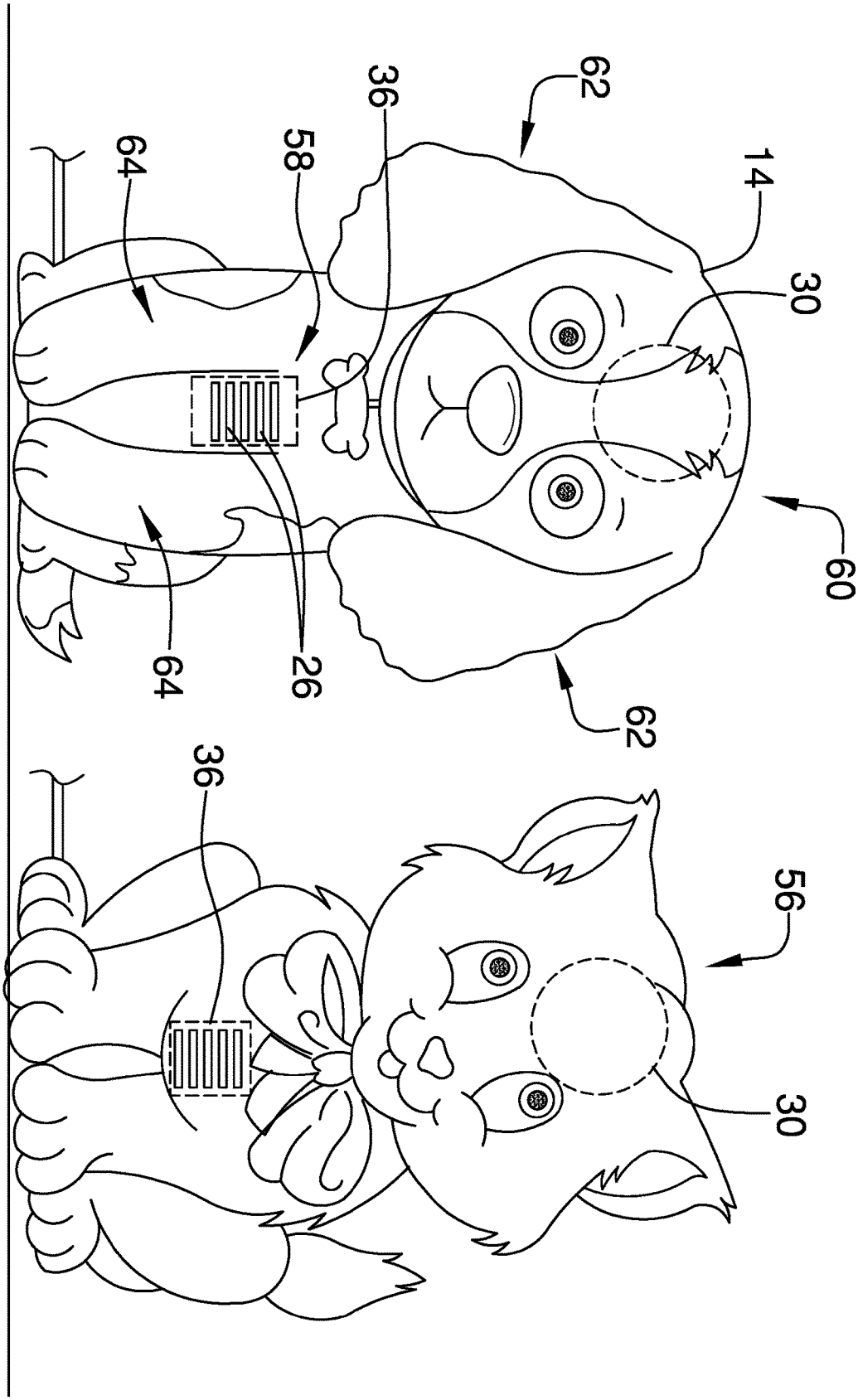
FIG. 4 is a front view of an embodiment of the disclosure.

In an alternative embodiment 56 as is most clearly shown in FIG. 4, the outer wall 14 of the housing 12 is structured to define a body 58, head 60, ears 62 and legs 64 of an animal. In this way the housing 12 can present the ornamental appearance of a cat, a dog or any other friendly animal. The head 60 is comprised of a semitranslucent material to emit a limited amount of light through the head 60. Each of the sound slots 26 extends through the body 58 and into the interior of the housing 12, and the speaker 36 is aligned with the sound slots 26 in the body. Additionally, the light emitter 30 is positioned in the head 60.

In use, the cassette 34 is inserted into the cassette reader 32 at night when the child is put into bed. Thus, the pre-recorded audio message is played to the child to help the child fall asleep. In this way a parent that is traveling for work, for example, can read a bed time story to the child when the parent is away. Additionally, a series of stories that were recorded onto cassette 34 at the time of manufacturing can be played to the child. The light emitter 30 emits a soothing, low intensity light to comfort the child's fear of the dark.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A night light assembly for assisting a child to fall asleep with a pre-recorded audio message and a low intensity light, said assembly comprising:

a housing having an outer wall being structured to resemble a star wherein said housing is configured to visually comfort a child, said housing being comprised of a semitranslucent material wherein said housing is configured to pass a limited amount of light through said housing;

a light emitter being positioned within said housing wherein said light emitter is configured to emit light outwardly through said housing thereby facilitating a child to be soothed by the light at night;

a cassette reader being integrated into said housing;

a cassette storing data comprising a pre-recorded audio message, said cassette being insertable into said cassette reader thereby facilitating said cassette reader to read said data on said cassette; and a speaker being integrated into said housing, said speaker being aligned with said speaker being aligned with said sound slots wherein said speaker is configured to emit audible sound outwardly through said sound slots, said speaker being in communication with said cassette reader for audibly emitting the pre-recorded message.

2. The assembly according to claim 1, wherein said housing has a front wall and a back wall, said outer wall extending between said front wall and said back wall, said outer wall having a plurality of intersecting sides, said intersecting sides being arranged to define a plurality of points each being distributed around said outer wall thereby facilitating said housing to have a star shape, said outer wall having a cassette slot extending into an interior of said housing, said cassette slot being positioned on a respective one of said intersecting sides, said front wall having a plurality of sound slots each extending into said interior of said housing wherein said plurality of sound slots is configured to pass audible sound through said sound slots, said front wall having indicia being printed thereon, said indicia comprising imagery of eyes and a smiling mouth wherein said indicia is configured to present the ornamental appearance of a person's face.

3. The assembly according to claim 2, wherein:

said cassette reader is aligned with said cassette slot in said outer wall of said housing; and said cassette is insertable into said cassette slot in said outer wall of said housing.

4. The assembly according to claim 2, wherein:

a plurality of control buttons, each of said control buttons being movably integrated into said back wall of said housing, each of said control buttons being electrically coupled to said cassette player, said plurality of control buttons including a stop button, a play button, a pause button and a power button;

a power supply being positioned in said housing, said power supply being electrically coupled to said cassette reader; and a power cord being coupled to and extending away from said outer wall of said housing, said power cord being electrically coupled to said power supply, said power cord having a distal end with respect to said housing, said distal end having a male plug being electrically coupled thereto wherein said male plug is configured to be plugged into a female electrical outlet.

5. A night light assembly for assisting a child to fall asleep with a pre-recorded audio message and a low intensity light, said assembly comprising:

a housing having an outer wall being structured to resemble a star wherein said housing is configured to visually comfort a child, said housing having a front wall and a back wall, said outer wall extending between said front wall and said back wall, said outer wall having a plurality of intersecting sides, said intersecting sides being arranged to define a plurality of points each being distributed around said outer wall thereby facilitating said housing to have a star shape, said outer wall having a cassette slot extending into an interior of said housing, said cassette slot being positioned on a respective one of said intersecting sides, said front wall having a plurality of sound slots each extending into said interior of said housing wherein said plurality of sound slots is configured to pass audible sound through said sound slots, said front wall having indicia being printed thereon, said indicia comprising imagery of eyes and a smiling mouth wherein said indicia is configured to present the ornamental appearance of a person's face, said housing being comprised of a semi-translucent material wherein said housing is configured to pass a limited amount of light through said housing;

a light emitter being positioned within said housing wherein said light emitter is configured to emit light outwardly through said housing thereby facilitating a child to be soothed by the light at night;

a cassette reader being integrated into said housing, said cassette reader being aligned with said cassette slot in said outer wall of said housing;

a cassette storing data comprising a pre-recorded audio message, said cassette being insertable into said cassette reader thereby facilitating said cassette reader to read said data on said cassette, said cassette being insertable into said cassette slot in said outer wall of said housing;

a speaker being integrated into said housing, said speaker being aligned with said speaker being aligned with said sound slots wherein said speaker is configured to emit audible sound outwardly through said sound slots, said speaker being electrically coupled to said cassette reader wherein said speaker is configured to audibly emit the pre-recorded audio message;

a plurality of control buttons, each of said control buttons being movably integrated into said back wall of said housing, each of said control buttons being electrically coupled to said cassette player, said plurality of control buttons including a stop button, a play button, a pause button and a power button;

a power supply being positioned in said housing, said power supply being electrically coupled to said cassette reader; and a power cord being coupled to and extending away from said outer wall of said housing, said power cord being electrically coupled to said power supply, said power cord having a distal end with respect to said housing, said distal end having a male plug being electrically coupled thereto wherein said male plug is configured to be plugged into a female electrical outlet.

6. The assembly according to claim 5, wherein said outer wall of said housing is structured to define a body, head, ears and legs of an animal wherein said housing is configured to present the ornamental appearance of a cat or a dog, said head being comprised of a semitranslucent material wherein said head is configured to emit a limited amount of light through said head, said body having a plurality of sound openings each extending into said interior of said housing, said speaker being aligned with said sound openings in said body, said light emitter being positioned in said head.

* * * * *